US008695732B2

(12) United States Patent
Blattner

(10) Patent No.: US 8,695,732 B2
(45) Date of Patent: Apr. 15, 2014

(54) EARTH-BORING CUTTER MOUNT AND ASSEMBLY

(76) Inventor: Stu Blattner, Golden, CO (US)

( * ) Notice: Subject to any disclaimer, the term of this patent is extended or adjusted under 35 U.S.C. 154(b) by 327 days.

(21) Appl. No.: 12/737,537

(22) PCT Filed: Sep. 16, 2008

(86) PCT No.: PCT/US2008/010755

§ 371 (c)(1),
(2), (4) Date: Jan. 24, 2011

(87) PCT Pub. No.: WO2010/033097

PCT Pub. Date: Mar. 25, 2010

(65) Prior Publication Data

US 2011/0220422 A1 Sep. 15, 2011

(51) Int. Cl.
*E21B 10/00* (2006.01)

(52) U.S. Cl.
USPC ..... 175/371; 175/359; 384/490; 384/504; 384/507; 384/508

(58) Field of Classification Search
CPC ..... E21B 10/25; E21B 10/22; E21B 10/24; E21B 10/23; E21B 4/003; B60B 27/0005; B60B 2380/12; B60B 2380/73; B60B 27/0094
See application file for complete search history.

(56) References Cited

U.S. PATENT DOCUMENTS

| | | | | |
|---|---|---|---|---|
| 3,749,188 | A * | 7/1973 | Schumacher, Jr. | 175/364 |
| 5,027,911 | A * | 7/1991 | Dysart | 175/57 |
| 5,363,930 | A * | 11/1994 | Hern | 175/228 |
| 6,076,972 | A * | 6/2000 | Yuasa et al. | 384/508 |
| 6,708,786 | B2 * | 3/2004 | Cariveau et al. | 175/371 |

* cited by examiner

*Primary Examiner* — Jennifer H Gay
*Assistant Examiner* — Caroline Butcher
(74) *Attorney, Agent, or Firm* — Scott L. Terrell, P.C.; Scott L. Terrell

(57) ABSTRACT

A rotary cutter mount for an earth-boring cutter is provided which includes a ball bearing journal [100] adapted to be coupled to a cutter body [210], having a minimum [110] and a maximum [120] cylindrical diameter, and a first [115] and second [116] mounting ends. The maximum diameter [120] defines a journal body [122] which includes an exterior surface adapted to be rotationally coupled to the interior surface of the cutter body [210] so as to allow the cutter body [210] to rotate freely with respect to the bearing journal [110]. The minimum [110] diameter defines a shaft portion having sealing surfaces. The first [115] and a second [116] mounting ends are shaped to enable a rotationally fixed positioning of the bearing journal [100] in a yoke of a corresponding cutter head-plate support bracket. A row of ball-bearing races [126] is recessed to extend circumferentially about the exterior surface of the journal body [122]. A ball loading passage [118] is formed to extend as a clear bore axially outward through the journal body [122] of the bearing journal [100].

7 Claims, 5 Drawing Sheets

EARTH-BORING CUTTER MOUNT AND ASSEMBLY

CROSS REFERENCE TO RELATED APPLICATIONS

This application is a submission to enter the national stage, pursuant to 35 U.S.C. §371, of PCT/US2008/010755, filed 16 Sep. 2008.

STATEMENT OF FEDERALLY SPONSORED RESEARCH

None.

BACKGROUND OF THE INVENTION

1. Technical Field

The present invention relates to rotary rock cutters. In particular, it relates to an earth-boring rock cutter mount and cutter assembly for use in conjunction with a raised bore head-plate for widening the diameter of a bore hole.

2. Background Art

Industrial earth-boring cutter assemblies, such as the type used in conjunction with a raised bore head-plates for widening the diameter or a bore hole are well known in the art. These assemblies have evolved along a common conception in the design of rotary cutters. Up until now, a few such examples exist. As shown in FIG. 1, one such example is shown and described in U.S. Pub. No. 2002/0166702 (filed May 7, 2002) to Cariveau et. al. As described therein, this conception in design generally includes cutter 1, an a central journal assembly 2 on which a cutter body 3 is rotatably mounted. The cutter body 3 generally includes ribs and hardened inserts 4 to break up and crush the outer diameter surface of a bore hole when the cutter body 3 is pressed against and rolled over the formation 5. The cutter 1 is a raised bore cutter, which includes a ball bearing 10 and roller bearings 11 disposed between the journal assembly 2 and the cutter body 3 to allow the cutter body 3 to rotate freely with respect to the journal assembly 2. The ball bearing 10 is usually provided to carry an axial load through the bearing, and the one or more roller bearing 11 are typically provided to carry radial loads. In this configuration, the roller bearing 11 are placed around the journal assembly 2 prior to sliding the journal assembly 2 into the cutter body 3. Then the ball bearing 10 is put into place by inserting bearing balls through the ball hole 13 in the journal 2. Once the bearing balls are in place, a ball plug 12 is inserted into the ball loading hole 13 and then a ball plug retainer 14 is inserted into the journal 2 to retain the ball plug 12 in place.

To alleviate concerns relating to damage caused to the bearing balls of the ball bearing 10 and edges of the ball loading hole 13, cutter designs, known in the art, have the ball hole 13 placed at, or near, 180 degrees from the load bearing zone of the journal assembly 2. While this configuration ensures little or no load on the ball loading hole, this design does not allow for rotation of the journal in order to prolong journal bearing surface life.

Another example is also shown and described as the subject matter in U.S. Pub. No. 2002/0166702 (filed May 7, 2002) to Cariveau et. al. There, Cariveau et al. discloses a rotatable journal for an earth-boring cutter which includes a bearing journal adapted to be coupled to a cutter body. The first mounting end of the bearing journal is shaped to enable rotationally fixed position in a corresponding yoke. The yoke is operatively coupled to the body of the cutter. A single ball race is formed in an exterior surface of the journal. The loading passage is formed in the journal. The ball loading passage has an exit hole on the race. The hole is positioned so that is disposed in a rotary orientation which is at a selected angular displacement from the maximum radial loading of the journal. The first mounting end and the corresponding yoke are adapted to enable a plurality of rotary orientations. Each of the rotary orientations is such that the hole is oriented other than in the direction of maximum radial loading. As described therein, Cariveau et al. seeks to increase bearing life as a result of spalling and flaking off of material from the journal bearing surface by permitting rotation of the journal so that a previously unloaded surface may be subsequently used to carry load while maintaining the ball loading in an angular orientation outside of the load bearing zone.

While the foregoing examples offer some utility, a major disadvantage in each lies in the fact that, while they do provide for some alleviation of damage to the bearing balls, the journal surface, and ball loading holes by locating the ball loading hole in a position outside of the load bearing zone and for rotation of the journal, they are complex in design, are thereby costly in manufacture and service. Thus, it is desirable to provide a ball bearing earth-boring mount and assembly which is capable of rotation, simple in design, and less costly in manufacture and servicing. It is also desirable to provide an earth-boring cutter which eliminates the concerns, of the prior art, relating to the orientation of the ball loading exit hole in relation to the load bearing zone, but which also satisfies a need to prolong bearing and journal life. The present invention satisfies these needs.

SUMMARY OF THE INVENTION

It is therefore an object of the present invention to provide a symmetrical ball bearing earth-boring mount which is capable of rotation, simple in design, and less costly in manufacture and servicing.

It is another object of the present invention to provide an earth-boring cutter which eliminates the concerns, of the prior art, relating to the orientation of the ball loading exit hole in relation to the load bearing zone, but which also satisfies a need to prolong bearing and journal life.

It is yet another object of the present invention to provide a ball bearing earth-boring mount which is capable of rotation and reversal to extend the life of the bearing journal and which eliminates the ball loading exit hole problems associated with the prior art designs.

To overcome the problems of the prior art methods and in accordance with the purpose of the invention, as embodied and broadly described herein, briefly a rotary cutter mount for an earth-boring cutter is provided which includes a symmetrical ball bearing journal adapted to be coupled to a cutter body, having a minimum and a maximum cylindrical diameter, and a first and second mounting ends. The maximum diameter defines a journal body which includes an exterior surface adapted to be rotationally coupled to the interior surface of the cutter body so as to allow the cutter body to rotate freely with respect to the bearing journal. The minimum diameter defines a shaft portion, having sealing surfaces. The first and second mounting ends are shaped to enable a rotationally fixed positioning of the bearing journal in a yoke of a corresponding cutter head-plate support bracket. A row of ball-bearing races is recessed to extend circumferentially about the exterior surface of the journal body. A ball loading passage is formed to extend as a clear bore axially through the journal body of the bearing journal.

Additional advantages of the present invention will be set forth in part in the description that follows and in part will be obvious from that description or can be learned from practice of the invention. The advantages of the invention can be realized and obtained by the apparatus particularly pointed out in the appended claims.

DESCRIPTION OF THE DRAWINGS

The accompanying drawings, which are incorporated in and which constitute a part of the specification, illustrate at least one embodiment of the invention, and together with the description, explain the principles of the invention.

DESCRIPTION OF THE PREFERRED EMBODIMENT

Figure 1:
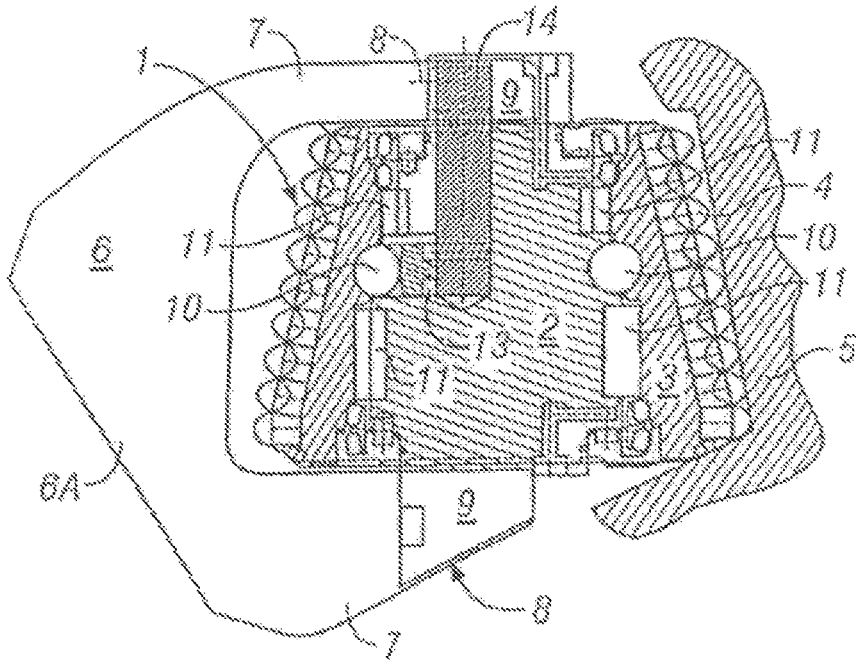
(Prior Art) Fig. 1
FIG. 1 shows an example of a prior art industrial cutter assembly.

Unless specifically defined otherwise, all technical or scientific terms used herein have the same meaning as commonly understood by one of ordinary skill in the art to which this invention belongs.

Although any of the methods and materials similar or equivalent to those described herein can be used in the practice or testing of the present invention, the preferred methods and materials are now described. Reference will now be made in detail to the presently preferred embodiments of the invention, examples of which are illustrated in the accompanying drawings wherein like numerals represent like features of the invention.

The invention provides an earth-boring cutter mount and assembly. Referring now to drawing FIGS. 2-4, the generally cylindrical rotary cutter mount for an earth-boring cutter is provided which includes a ball bearing journal 100 adapted to be coupled to a cutter body 210, having a minimum 110 and a maximum 120 cylindrical diameter, and a first 115 and second 116 mounting ends. The maximum diameter 120 defines a journal body 122 which includes an exterior surface adapted to be rotationally coupled to the interior surface of the cutter body 210 so as to allow the cutter body 210 to rotate freely with respect to the bearing journal 110. The first 115 and second 116 mounting ends are shaped to enable a rotationally fixed positioning of the bearing journal 110 in a yoke (not shown) of a corresponding cutter head-plate support bracket (not shown). A row of ball-bearing races 126 is recessed to extend circumferentially about the exterior surface of the journal body 122. A ball loading passage 118 is formed to extend as a clear bore axially through the journal body 122 of the bearing journal 110.

Figure 2:
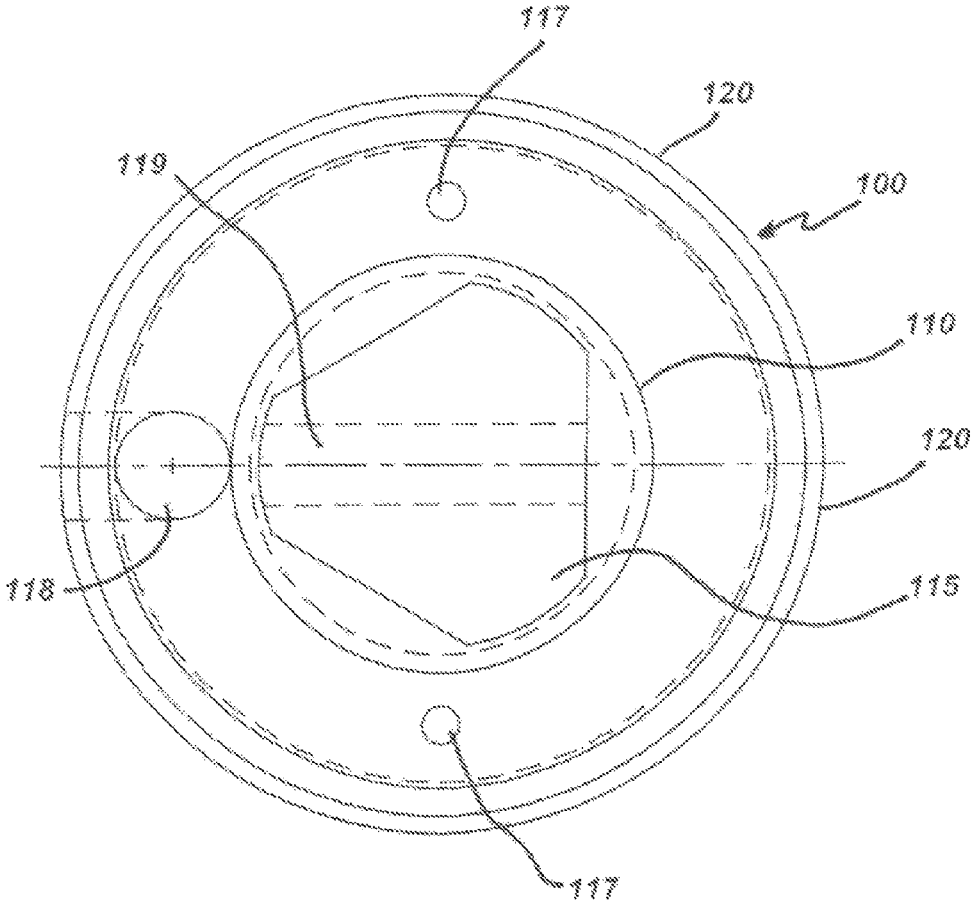
FIG. 2 is a shop drawing showing a frontal view of the bilaterally symmetrical cutter mount bearing journal in accordance with the present invention.
Figure 3:
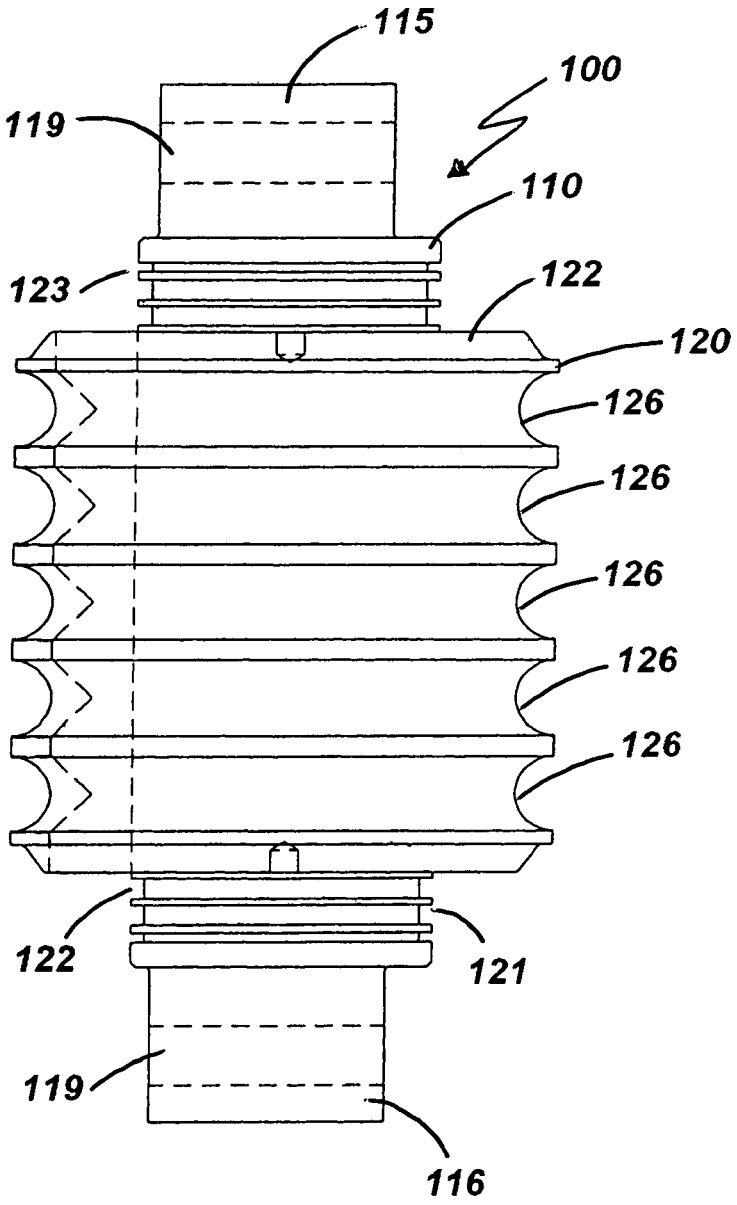
FIG. 3 is a shop drawing showing and a cross-sectional view in accordance with cutter mount of the present invention.

In the best mode of the invention, as shown in FIGS. 2-3, dowel holes 117, 0.953 cm×1.588 cm deep, are drilled for receiving dowel pins 238 for use in locating the sealing assembly when coupled to a cutter body 210. The ball loading passage through-hole 118, 2.963 cm in diameter, is formed to extend as a clear bore axially through the journal body 122 of the bearing journal 100 for receiving the ball plug 226. As shown in the drawing figures, in this manner the present invention eliminates the need for a ball passage exit hole, 180 degree orientation of the ball plug, and ball plug retainer, of the prior art, and the corresponding concerns over journal wear problems association therewith. It also provides a symmetrical design simpler in manufacture and servicing. Mounting members are preferably substantially triangular, but may be or any shape well know is the art such as octagonal, regular hexagon, a cross, or cylinder. A mounting clear hole 119 is provided in the mounting end portions 115, 116 of the bearing journal 100 for pinned connection to the yoke (not shown) of a support bracket on a raised bore cutter-headplate.

The bearing journal body 122 preferably extends 18.08 cm axially and includes a row of five side by side ball races 126 designed to receive twenty-two bearing balls per race, each having a diameter of 2.54 cm. In this manner, the present invention eliminates the need for extremely tight tolerances associated with the roller bearing designs, of the prior art, while maintaining satisfactory radial and axial loads in operation.

Figure 5:
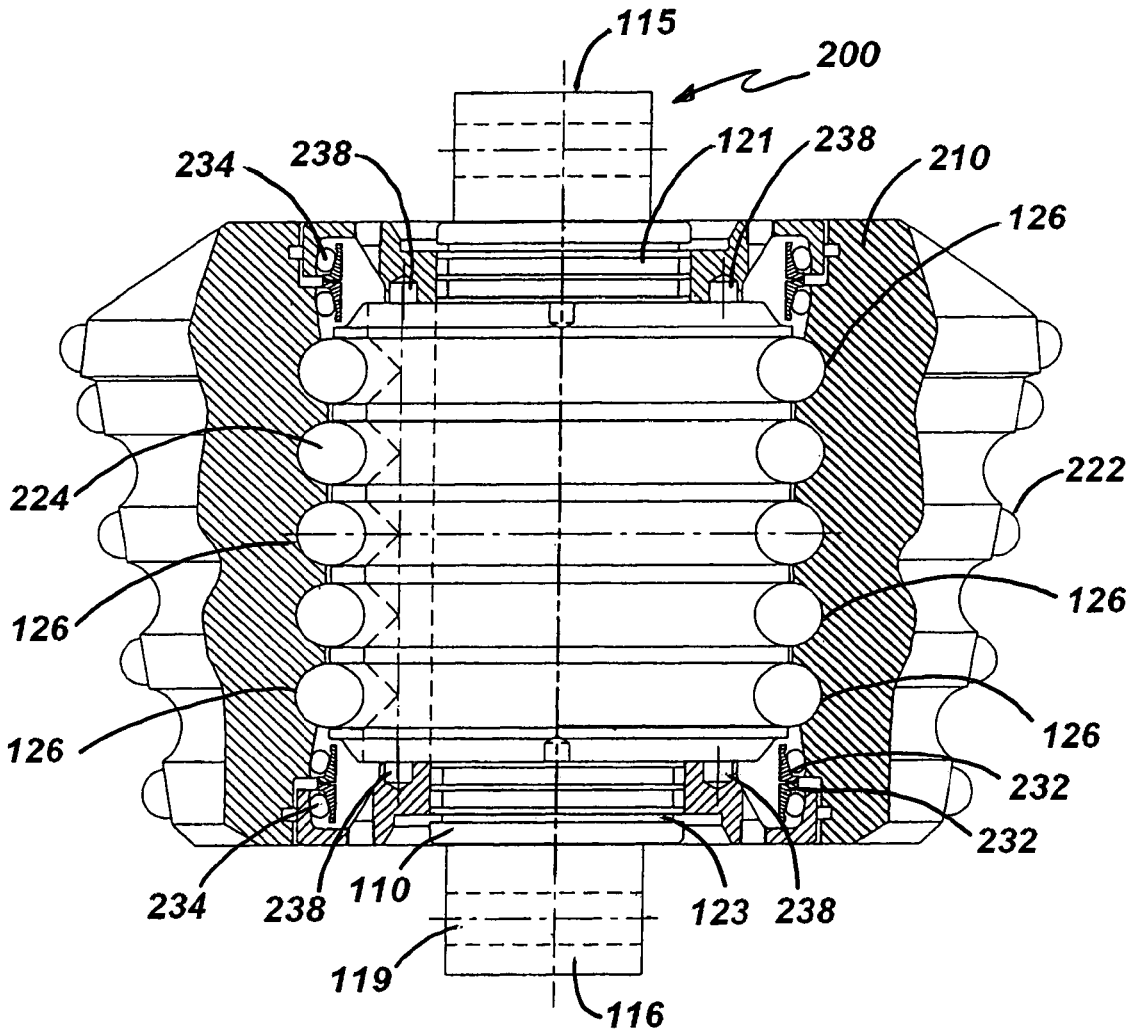
FIG. 5 is a shop drawing showing a sectional view of the cutter assembly in accordance with the present invention.

Referring now to FIGS. 3 and 5, in the best mode of the preferred embodiment, other elements of the bearing journal further include groves or recesses and surfaces for biasing a sealing assembly when the cutter mount is coupled to a cutter body such as O-ring recesses 121, 122 and outer seal retainer recesses 123.

Figure 4:
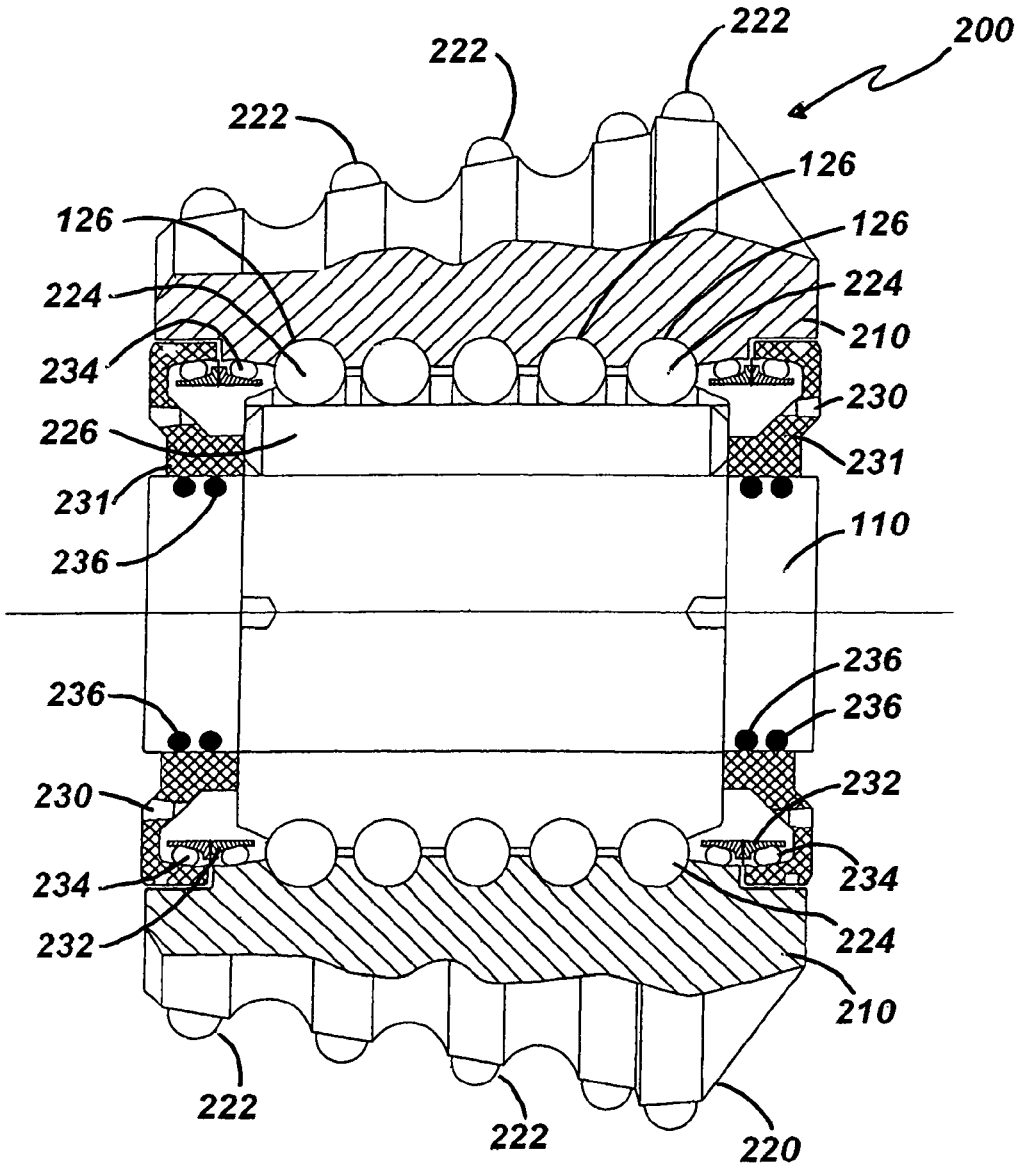
FIG. 4 is a shop drawing showing a sectional view of the cutter assembly in accordance with the present invention.

Referring now to FIGS. 4-6, an earth-boring cutter assembly 200 used in conjunction with a raise bore cutter head-plate for widening the diameter of a bore hole is also provided. The a rotary cutter body 210 preferably includes a substantially tapered exterior surface 220, a clear bore extending axially along a central longitudinal axis defining an interior surface for coupling to the ball bearing journal as described above. A plurality of circumferentially disposed rock crushing members 222 positioned around the exterior surface 220 of the cutter body 210. The rock crushing members 222 are of any type well known in the art such as tungsten carbide buttons. The ball bearing journal 110, described above, is adapted to be rotatably coupled to the cutter body 210. A row of diametrically opposed annular ball-bearing races 126 are each recessed to extend circumferentially about the exterior surface of the journal body and interior surface of the cutter body. A plurality of bearing balls 224, are disposed in roller contact with the annular ball-bearing races 126. Preferably each ball bearing race includes twenty-two 2.54 cm bearing balls. In this manner, the preferred embodiment includes one-hundred-twenty-two bearing balls. A substantially cylindrical ball plug 226 is provided to be slidably received in the ball bearing passage 118.

The other components of the earth-boring cutter assembly shown in the drawing figures include a sealing assembly having snap-retainer rings 230, end-caps 232, metal face seals 233, toric rings 234, O-rings 236, and dowel pins 238.

In addition to the design advantages over the prior art, the present invention provides ease in carrying out the invention in the form of assembly and servicing. Component parts are first thoroughly cleaned with a suitable solvent. The cutter body 210 is then placed, larger diameter downward on two 10.16 cm×10.16 cm wooden board members. One end of the ball bearing journal 110 is then slid into the cutter body 210 and aligned therein such that the ball bearing races 126 are diametrically opposed. The ball plug 226 is then slid into the ball passage 118 and supported upwardly in a position such that the middle ball race 126 may be filled with twenty-two bearing balls 224. The ball plug 226 is then moved upwardly one row of the ball races 126 and that race is filled, as above. This procedure is repeated for the top row of the ball races 126. The partially assembled cutter assembly 200 is then flipped over, and the above procedure is repeated, in sequence, for the last two rows of ball races 126. The dowel pins 238 are then placed in the bearing journal 110, two viton O-rings 236 are positioned on a shaft portion of the bearing journal 110, and lubricated with a suitable lubricant, such as a coat of oil. At each end, the dowel holes 117 are located on the end cap 231, preferably using a marker, and the metal face seals 232 and viton O-rings 236 are applied against the metal faces seals 232, respectively. The end-caps 231 are secured in place using the snap-retainer rings 230. To dissemble the cutter assembly for servicing, the above procedure is simply reversed.

While the present invention has been described in connection with the embodiments as described and illustrated above, it will be appreciated and understood by one of ordinary skill in the art that modifications may be made in the cutter mount and assembly without departing from the true spirit and scope of the invention as described and claimed herein.

I claim:

1. A rotary cutter mount for an earth-boring cutter, comprising:

(a) a ball-bearing journal body adapted to be coupled to a cutter body, having a minimum and a maximum diameter, and a first and second opposite ends, the maximum diameter defining a cylindrical journal body which includes an exterior bearing surface adapted to be rotationally coupled to the interior surface of the cutter body so as to allow the cutter body to rotate freely with respect to the bearing journal, the minimum diameter defining a shaft portion, having sealing surfaces, and the first and second ends including mounting portions shaped to enable rotationally fixed positioning of the bearing journal in a yoke of a corresponding cutter head-plate support bracket;

(b) at least two rows of annular ball-bearing races recessed in the exterior bearing surface so that said recesses extend circumferentially about the exterior bearing surface of the journal body;

(c) a plurality of bearing balls;

(d) a transverse longitudinal ball plug adapted to retain said bearing balls in each of said races; and (e) a clear bore being a ball loading and retaining passage extending longitudinally through said journal body, said clear bore positioned in a transverse horizontally-spaced relationship with respect to each of said rows of annular races, so that said transverse ball plug extends longitudinally through said journal body for loading and retaining said bearing balls in said races.

2. The rotary cutter mount for the earth-boring cutter in accordance with claim 1, wherein the row of ball-bearing races comprises five side by side races.

3. The rotary cutter mount for the earth-boring cutter in accordance with claim 1, wherein the shape of the bearing journal first and second mounting ends includes a surface adapted to rest on top of a yoke having a substantially triangular upper surface.

4. An earth-boring cutter assembly used in conjunction with a raise bore cutter head-plate for widening the diameter of a bore hole, comprising:

(a) a rotary cutter body having a tapered exterior surface, a clear bore extending axially along a central longitudinal axis defining an interior surface, and sealing surfaces;

(b) a plurality of circumferentially disposed rock crushing members positioned around the exterior surface of the cutter body;

(c) a ball bearing journal adapted to be coupled to the cutter body, having a minimum and a maximum diameter, and a first and a second opposite ends, the maximum diameter defining a cylindrical journal body which includes an exterior surface adapted to be rotationally coupled to the interior surface of the cutter body so as to allow the cutter body to rotate freely with respect to the bearing journal, the minimum diameter defining a shaft portion, having sealing surfaces, and the first and second ends including mounting portions shaped to enable rotationally fixed positioning of the bearing journal in a yoke of a corresponding cutter head-plate support bracket;

(d) at least two rows of diametrical opposed annular ball-bearing races each of said two rows of races recessed to extend circumferentially about the exterior surface of said journal body and interior surface of said cutter body;

(e) a plurality of bearing balls disposed in roller contact with said annular ball-bearing races;

(f) a transverse longitudinal ball plug adapted to retain said bearing balls in each of said races; a clear bore being a ball loading and retaining passage extending longitudinally through said journal body, said clear bore positioned in a transverse horizontally-spaced relationship with respect to each of said rows of annular races, so that said transverse ball plug extends longitudinally through said journal body for loading and retaining said bearing balls in said annular races; and (h) a means for sealing said cutter body when rotationally coupled to the bearing journal.

5. The earth-boring cutter in accordance with claim 4, wherein the row of annular ball-bearing races comprises five side by side races.

6. The earth-boring cutter in accordance with claim 4, wherein the shape of the bearing journal first and second mounting ends includes a surface adapted to rest on top of a yoke having a substantially triangular upper surface.

7. The earth-boring cutter in accordance with claim 5, wherein the plurality of ball bearings in each annular race is twenty-two.

* * * * *